United States Patent [19]

Lindbergh

[11] 3,940,892

[45] Mar. 2, 1976

[54] SELF-ERECTING AIRCRAFT STRUCTURE

[76] Inventor: Charles Lindbergh, Hqs. USAFE-DE-POB 8155 APO, New York, N.Y. 09012

[22] Filed: May 23, 1974

[21] Appl. No.: 472,927

[52] U.S. Cl. ..... 52/86; 52/64; 52/646; 52/71; 52/69

[51] Int. Cl.[2] ..... E04B 1/32

[58] Field of Search ..... 52/83, 86, 71, 224, 223, 52/225, 226, 640, 645, 646, 2, 64, 127, 173, 222, 80, 81

[56] References Cited

UNITED STATES PATENTS

| | | | |
|---|---|---|---|
| 2,793,720 | 5/1957 | Hawes | 52/645 |
| 2,985,264 | 5/1961 | Leonard | 52/645 |
| 3,084,909 | 4/1963 | Carr | 52/225 |
| 3,559,353 | 2/1971 | Partridge | 52/86 |

*Primary Examiner*—Ernest R. Purser
*Assistant Examiner*—Robert Farber
*Attorney, Agent, or Firm*—Joseph E. Rusz; Arsen Tashjian

[57] ABSTRACT

A self-erecting structure including a plurality of trusses joined by cables with a hydraulic system for producing relative rotation of the trusses at their juncture axes. The trusses comprise series of subelements hinged at common juncture I-beams. The cables effectively join adjacent structural subelements and the hydraulic system includes a plurality of hydraulic elements having their outer casings secured to the I-beams and their piston elements extending downwardly against the cable. Upon the application of hydraulic pressure, the outer casing and juncture I-beams move upward in opposition to the restraint of the cables causing relative rotation at the junctures of adjacent trusses to the desired angular position thereby producing an arch bay section. The curved edges of a series of arches are connected together to form the self-erecting structure.

2 Claims, 6 Drawing Figures

SELF-ERECTING AIRCRAFT STRUCTURE

BACKGROUND OF THE INVENTION

This invention relates to a portable self-erecting structure and, more particularly, the invention is concerned with providing a "pop-up" structure suitable for housing aircraft wherein a series of hydraulic elements which are an integral part of the structure, produce a relative rotation between adjacent structural elements resulting in the progressive erection of the composite structure.

Future requirements for tactical air power are expected to remain much as they are today — rapid deployment, a timely weapon system application, and a quick and effective weapon system recovery and redeployment. Often, the site of deployment and air operations is a hostile zone, subject to random rocket and mortar attacks. Thus, for successful air operations, the appropriate weapons system support facilities must be included in the activity. These facilities should consist of easily transported and quickly erected shelters to give adequate weather protection and be expandable to a hardened structure, if needed, without hindering the mission.

The hereinafter described self-erecting aircraft shelter has many potential military applications. This structure and its construction technique provide for increased mobility and speed and ease of construction, combined with rapid recovery and efficient storage. Engineers with some imagination, by slightly modifying its configuration, could adapt the structure as a general-purpose space frame suitable for a number of military functions.

The possibility also exists of using this type of shelter on a very mobile basis to cover aircraft which are down for maintenance at remote installations or in severe weather conditions. The structure could be flown to the site of the downed aircraft, erected over it to provide shelter while maintenance was being performed, and then recovered when the work was finished.

Also, there are situations where a mobile installation must be converted to a permanent installation for sustained air operations. In many cases it is necessary to replace temporary structures with more durable ones because of extended time required for the mission. Obviously, this is uneconomical and may interrupt daily air operations. The pop-up shelter as it stands in the field in its soft-mobile form can be considered a soft-permanent structure. Its structural strength can be increased by explosively welding together all the hinged joints and hydraulic elements. For this operation, the explosives would be pre-positioned on the structure, go up with the elements to the desired erection mode, and detonate on command.

Mobile shelters should be suitable for conversion not only to soft-permanent structures without replacement or major modification, but also to hardened-permanent structures. This shelter is adaptable to that requirement. The basic structure explosively welded together can serve as the primary frame for a hardened structure. Instead of installing conventional roof panels which would provide only weather protection and insulation, a more shock-resistant panel could be installed. While precast concrete panels could easily be utilized, this would require heavy construction equipment at the job site, the elimination of which up to this point has been an advantage. To obviate this, hollow roof panels could be erected as integral components of the structure, and concrete pumped into them to form concrete panels.

A hardened shelter must be able to withstand mortar and rocket barrages as well as a general overpressure resulting from the application of more strategic weapons. Thus, for a hardened-permanent structure to be effective in withstanding dynamic loads, it must be able to deform enough to dissipate shock energy without deflection to failure. In this modification the concrete roof panels would be connected longitudinally at the truss points by embedded steel plates explosively welded together to form moment connectors. In addition, the hydraulic elements and connecting cables could be springloaded in a manner similar to that of a shock absorber to assist in dissipating shock energy.

SUMMARY OF THE INVENTION

The present invention provides a self-erecting structure for aircraft or the like wherein the basic structural synthesis and provided integral structural components permit the inducement of desired joint relative rotations and, as a system permit the field erection of a fabricated structure without the need for heavy conventional equipment or elevated worker activity. The same system also permits the recovery of the structure.

The completed structure comprises an assembly of structural elements which join one another at certain angles of relative inclination. Such angles are formed immediately upon the final positioning and final joining of the structural elements. In the case of the superstructure, heavy equipment is usually used for this placement which occurs after other structural members have been placed in separate sequences. The structure erection method and devices constituting this invention permit a very different and more economical means of construction for certain common types and configurations of structures. Specifically, in such cases, it allows the entire structure to be assembled at ground elevation and then erected using an internal means. Thus, the invention is termed a "self-erecting" structure. The exceptional economy in time and money result from complete fabrication being permitted at ground level and, secondly, the repeated relocation and reuse of the structure made possible by a de-erection procedure very similar to the initial erection procedure.

Accordingly, it is an object of the invention to provide a means for constructing a facility without significant above ground level work required. Consequently, scaffolding, form work and high working heights are eliminated. In addition to savings in time and money being realized, the safety aspects of working conditions would be enhanced. The aircraft shelter is but one example.

Another object of the invention is to provide a scaffolding system, the height of which can be easily adjusted. This allows great flexibility and ease of operation in activities such as aircraft and building maintenance and construction.

Still another object of the invention is to provide a self-erecting structure which permits great mobility such as certain military and civilian construction activities demand. The structural system is as easily de-erected as it is erected. Relocation and re-erection presents no problem.

A further object of the invention is to provide a self-erecting structure which can also serve as a lifting substructure to position permanent structural components.

Once such components are in their final positions, they would be conventionally joined, forming a self-sufficient structure. At which time, the self-erecting lift structure would be lowered and removed.

A still further object of the invention is to provide a self-erecting structure which is useful in positioning form work for concrete placement. Once the concrete has been placed and has set, the structural system is lowered and removed. The conventional approach for curved geometries requires extensive field form work fabrication prior to concrete placement. This capability would greatly minimize on-site construction time.

These and other objects, features and advantages will become more apparent after considering the following description taken in conjunction with the annexed drawing and appended claims.

DESCRIPTION OF A PREFERRED EMBODIMENT

Figure 1:
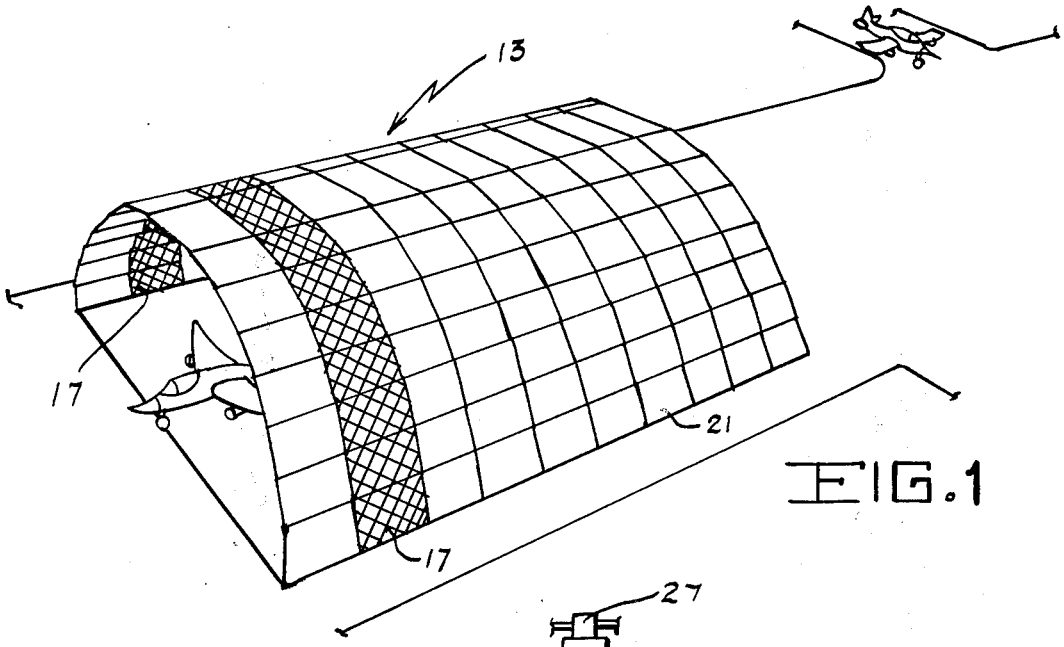
FIG. 1 is a view in perspective of a fully deployed self-erecting aircraft structure according to the invention showing a typical trussed arch section in detail.

Referring now to the drawings, the invented capability is illustrated in FIG. 1 which shows an arch structure 13 like that commonly used to shelter aircraft. In general, the desired structure is sythesized to consist of a system of structural subelements which when completed assembled at ground level represent the desired final erected configuration with the exception of the attainment of the final angles of relative rotation between the structural subelements. These are produced by using an internal means to force the common hinged juncture of adjacent structural subelements to move vertically relative to their outer ends. If such an activity is caused to take place at each of the structural subelement junctures, the structural assembly as a whole will gradually erect itself into the desired final configuration. The facility is self-erecting in that hydraulic elements, installed as an integral part of the structure, produce a relative rotation between structural elements which results in the progressive erection of the composite structure. Thus, the shelter is erected without the use of heavy construction equipment after the structure is fully pre-assembled while it is at ground level.

Figure 2A:
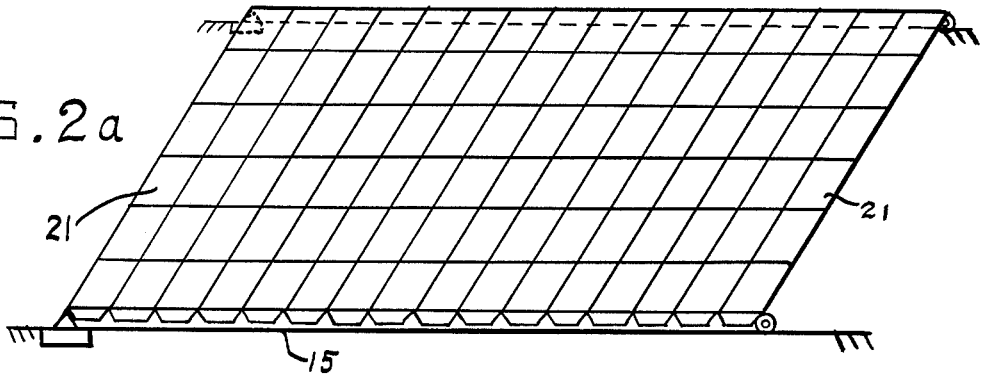
FIGS. 2*a*, 2*b* and 2*c* are idealized views in isometric of the self-erecting structure showing the sequence of erection events.
Figure 2B:
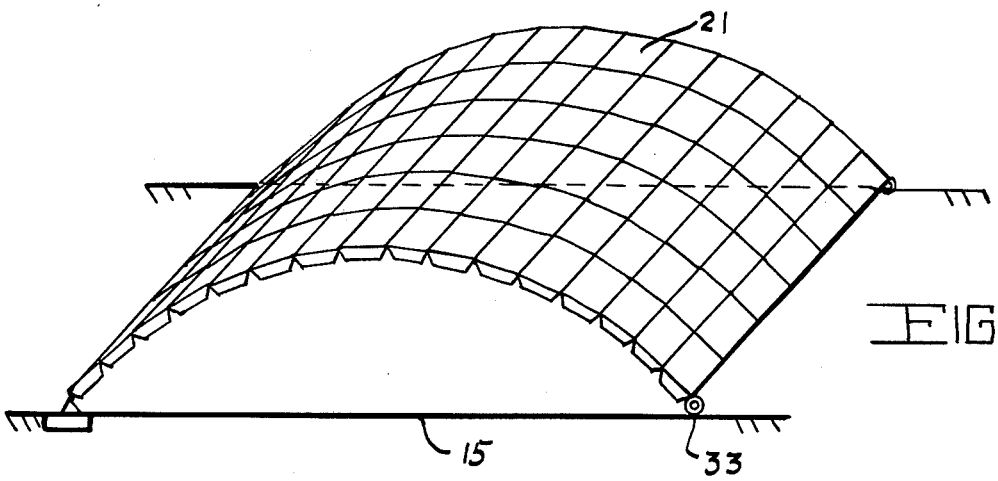
Figure 2C:
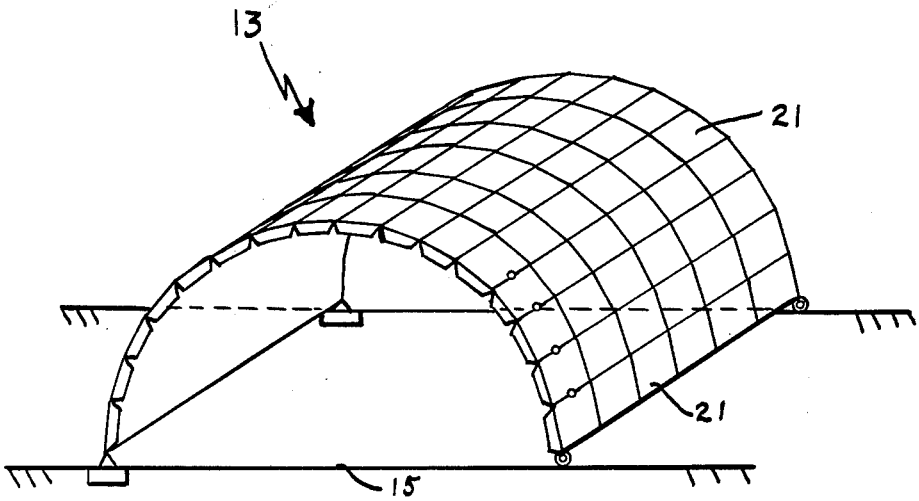

FIG. 2*a* illustrates the initial configuration as totally fabricated in the horizontal plane 15, FIG. 2*b* shows an intermediate configuration common to this erection scheme and FIG. 2*c* illustrates the desired final configuration. A representative typical arch bay is indicated in FIG. 1 as the shaded region 17. The arch bay can be considered as comprising many truss elements hinged at common juncture I beams 19 as shown most clearly in FIGS. 3*a* and 3*b* which illustrates two adjacent truss elements 21. In this embodiment, an extendable hydraulic element 23 and structural tie member 25 placed as an integral part of the structure are used to produce the desired angle of relative rotation between the adjacent elements 21.

Figure 3A:
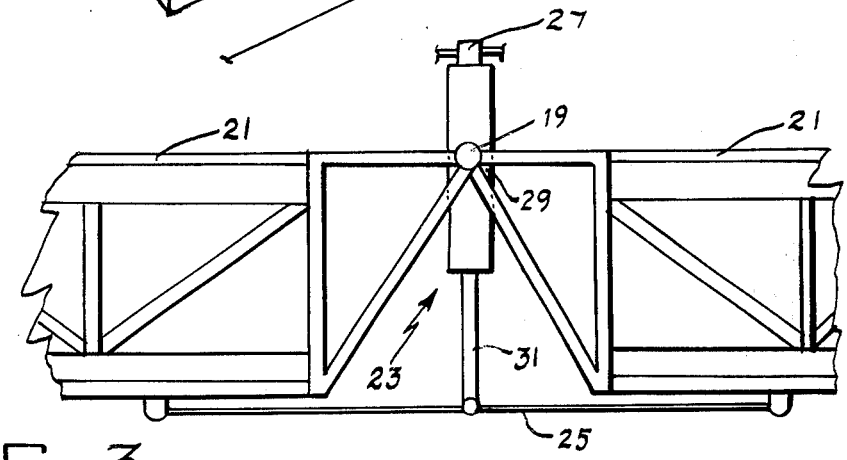
FIGS. 3*a* and 3*b* are side views of one of the hinged junctures showing the hydraulic system and cable prior to applying pressure and after applying pressure, respectively.
Figure 3B:
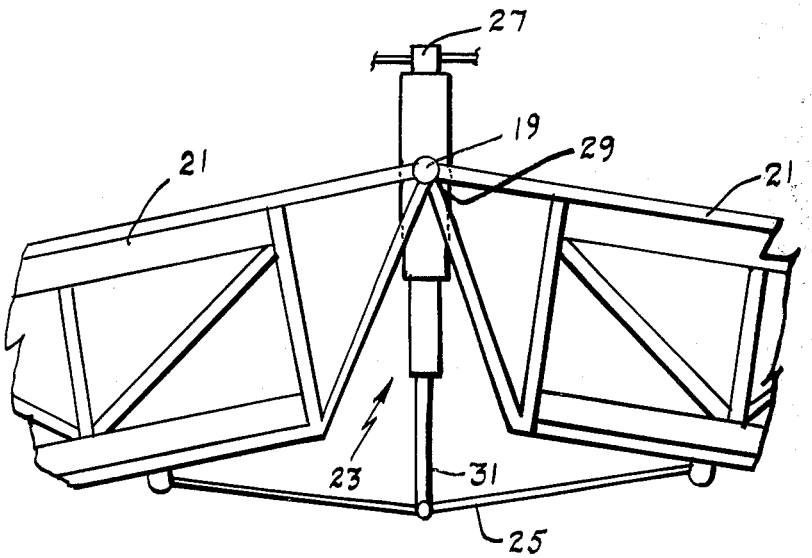

As illustrated in FIGS. 3*a* and 3*b*, the hydraulic element 23 is caused to extend through fluid under pressure entering at the fitting 27. The outer casing 29 of the hydraulic element 23 is secured to the I-beam structure of the truss element 21 at the juncture 19. The travel of the piston 31 of the element 23 is resisted by the structural ties 25, which are preferably wire cables that joint the lower end of the piston 31 to points on adjacent structural subelements 21. Through such restraint the outer casing 29 along with the juncture I-beam must move upward as the hydraulic element 23 extends. Thus, the desired final angle of relative rotation is achieved at the subelement juncture 19.

In a typical arch bay construction, a plurality of truss subelements 21 are positioned in a side-by-side relationship to form a long row with a hydraulic element 23 at the juncture 19 of each of the adjacent subelements 21. In the preferred embodiment shown in FIGS. 2*a*, 2*b* and 2*c*, there are sixteen truss subelements 21 in each row so that a progressive erection of each bay arch and, hence the total shelter can be accomplished by applying fluid pressure to each of the hydraulic elements 23. Conventional pumps, manifold and hydraulic conduits service the hydraulic elements 23. If a uniform rate of erection across the structure is desired, the hydraulic system must be capable of delivering different pressures at any one time to the various hydraulic elements since the required axial forces vary with the joint positions. Several conventional approaches may be used for this purpose. For example, the piston sizes may be varied so that one common applied hydraulic pressure will result in the required variation of piston force with position to piston. In the case of the arch, it would be feasible to use several pumps each serving independent service lines. Once final erection is achieved, mechanical slip devices can be used to fix the pistons 31 relative to their housings 29. At this point, the hydraulic pressure can be relieved. In order to preclude a catastrophic structural failure during erection or de-erection due to sudden hydraulic pressure loss, pressure activated braking bands can be incorporated into the hydraulic element housing. Upon loss of pressure, these brakes would automatically be activated prohibiting further relative motion of the piston 31. To de-erect, the system is repressurized and the mechanical slip devices disengaged. At this point, the hydraulic pressure can be reduced and the structure, responding to gravity forces, consequently lowered. Once at ground level, it can be disassembled and relocated for other uses.

If the structure is intended to remain erected, the relative position of the piston 31 to its housing 29 can be fixed either mechanically or through the use of explosive impulse welding or swaging. These means are currently in common related use. Another means would require both end supports to be fixed to withstand end thrusts. A conventional tie member or heavy foundation devices would be sufficient. In any case, the hydraulic fluid would be recovered. Other means to produce the relative rotation are possible. Rather than using a hydraulic element that extends to develop the required relative joint rotation, a contracting hydraulic element could be used. In addition, a worm gear assembly could also be used to provide relative joint rotation. With the winding of the cables upon a drive shaft, tensile forces could be created which would develop an upward thrust upon the juncture beam, as in the case of the extending hydraulic element, an offset in the direction of the load applied to the adjacent structural elements is necessary to most feasibly provide the thrust upward on the junction beam in order to initiate the relative rotation. Space frame erection is also possible using the same mechanism and principles.

CONSTRUCTION SEQUENCE

The erection sequence for the hereinbefore described structure is shown in FIGS. 2*a*, 2*b* and 2*c*. The shelter 13 is prefabricated so that it can be air-transportable in a C-130 aircraft or equivalent, or trucked on pallets from a storage depot to the construction site. At the site, the components 21 are laid out and hinged together at the junctures 19, and the hydraulic elements 23 are connected to a pump at the fitting 27. Roof panels are then installed between the truss sections 21 and flashing is placed at the hinges 19 for weather protection. The pump is activated, the pistons 31 are displaced, and the relative rotation at the joints 19 is developed which cumulatively forms a structurally stable arch. When the required relative rotation has been achieved and the erection sequence is complete, valves controlling the hydraulic elements 23 are closed, the pump is disconnected, and the free end of the arch having the wheels 33 attached thereto is pinned to a foundation deadman. For added structural stability at the joints 19, automatically locking mechanical fasteners may be included to maintain the position and act as a backup system if a closed valve should leak. To recover the structure, the foundation pins are removed, the valves are opened, and the structure relaxes in a very stable manner. On the ground, the roof panels and flashing are removed, the trusses 21 are disassembled, and the components are remounted on pallets for redeployment.

By using a single pump, an essentially uniform pressure is applied to the hydraulic elements 23 all of uniform size. Thus, the hydraulic forces applied to the trusses 21 through the cables 25 are the same. But the resisting truss dead-weight forces are not uniform, varying with respect to position in the structure and the degree of structural erection. Hence, in order to achieve simultaneous uniform relative rotation in all of the joints 19, the manifold must be carefully manipulated. All required forces are greatest as the erection procedure begins. The center piston force requirement always is greatest as the uniform relative rotation development begins. As this relative rotation in the joints develops, the dead weight is redistributed largely to the fixed and rollered ends, and the forces against which the piston acts decrease accordingly.

In a preferred embodiment of the self-erecting aircraft structure according to the invention, a shelter for F-4 and F-111 aircraft was designed with 16 truss sections laid side-by-side. The three structural systems include roof panels and supporting truss assemblies, tie cables, and a hydraulic system. The trusses carry the primary live loads applied to the structure after erection and some of the dead load. The cable serves as a structural tie connector between the adjacent static trusses and the hydraulic system. As the hydraulic element extends, the relative angle between adjacent trussed arch elements must increase since the cable and truss lengths remain unchanged. Inversely, as the hydraulic element reduces its length, so does the angle of relative rotation with the aid of gravity forces.

Although the invention has been illustrated in the accompanying drawings and described in the foregoing specification in terms of a preferred embodiment thereof, the invention is not limited to this embodiment or to the particular configuration disclosed. It will be apparent to those skilled in the art that other uses can be made of the hereinbefore described self-erecting structure including the rapid deployment and redeployment of weapons systems particularly in a hostile zone subject to random rocket and mortar attacks. Also, it should be noted that full field assembly of the structure can be completed on ground level without the use of heavy construction equipment.

Having thus set forth and described the nature of our invention, what we claim and desire to secure by Letters Patent of the United States is:

1. A self-erecting structure for use in the storage of aircraft and the like, said structure comprising a series of bay arches in a row forming a building structure, each of said arches including a plurality of truss subelements in side-by-side relationship, each of said truss subelements being hingedly connected to the next adjacent truss subelement, one end of said plurality of truss subelements being pivotally attached to a point on ground level and a pair of rotatable wheels attached to the other end to permit rolling motion along ground level during relative rotation of adjacent truss subelements, and means for erecting said structure by causing a relative rotation of adjacent truss subelements to increase the relative angle therebetween thereby forming an arch bay for attachment to other similarly configurated arch bays to produce the self-erecting building structure.

2. The self-erecting structure defined in claim 1 wherein the means for producing relative rotation between said truss subelements includes a hydraulic system comprising, in combination, a plurality of hydraulic elements corresponding structural tie members, each of said hydraulic elements having outer casings and extendible members, the outer casings of said hydraulic members being fixedly attached to the juncture between adjacent truss subelements and the lower end of the extendible member being attached to the structural tie member, each end of said structural tie member being fixed to the central lower surface of adjacent truss subelements such that the extension of the extendible member being restrained from downward movement by the structural tie member produces a corresponding upward movement of the outer casing attached to the juncture between said adjacent truss subelements thereby causing a rotation and increase of the relative angle between said adjacent truss subelements.

* * * * *